US011081812B2

(12) United States Patent
Onuma

(10) Patent No.: US 11,081,812 B2
(45) Date of Patent: Aug. 3, 2021

(54) ELECTRIC WIRE WITH TERMINAL

(71) Applicant: Yazaki Corporation, Tokyo (JP)

(72) Inventor: Masanori Onuma, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/856,002

(22) Filed: Apr. 22, 2020

(65) Prior Publication Data

US 2020/0373685 A1 Nov. 26, 2020

(30) Foreign Application Priority Data

May 21, 2019 (JP) ..... JP2019-095020

(51) Int. Cl.
*H01R 4/18* (2006.01)
*H01R 4/70* (2006.01)

(52) U.S. Cl.
CPC ..... *H01R 4/185* (2013.01); *H01R 4/70* (2013.01)

(58) Field of Classification Search
CPC ..... H01R 4/185; H01R 4/70; H01R 4/188; H01R 43/048
USPC ..... 439/877
See application file for complete search history.

(56) References Cited

U.S. PATENT DOCUMENTS 8,622,775 B2 * 1/2014 Takashima ..... H01R 4/185 439/886
9,083,100 B2 * 7/2015 Uno ..... H01R 43/24
9,543,689 B2 * 1/2017 Sato ..... H01R 4/188
9,640,933 B2 * 5/2017 Kawamura ..... H01R 4/183
9,663,863 B2 * 5/2017 Takata ..... H01B 7/28
9,748,724 B2 * 8/2017 Sato ..... H01R 43/24
10,186,795 B2 * 1/2019 Ikeya ..... H01B 1/02
10,361,492 B1 * 7/2019 Yamashita ..... H01R 4/70
2013/0126234 A1 * 5/2013 Ono ..... H02G 15/08 174/75 R
2013/0213709 A1 * 8/2013 Kawamura ..... H01R 4/183 174/72 A
2013/0252481 A1 * 9/2013 Sato ..... H01R 43/005 439/736
2014/0335741 A1 * 11/2014 Uno ..... H01R 4/70 439/736
2014/0349501 A1 * 11/2014 Aizawa ..... H01R 13/5221 439/190
2017/0085012 A1 * 3/2017 Kayama ..... H01R 13/533
2018/0109088 A1 * 4/2018 Takayanagi ..... H01R 4/188
2018/0375276 A1 * 12/2018 Onuma ..... H01R 43/005

FOREIGN PATENT DOCUMENTS

JP 2015-41404 A 3/2015
JP 2016-181387 A 10/2016

* cited by examiner

*Primary Examiner* — Peter G Leigh
(74) *Attorney, Agent, or Firm* — Kenealy Vaidya LLP

(57) ABSTRACT

An electric wire with a terminal includes an electric wire having a core wire and a covering, a crimp terminal including a core wire crimp portion crimped to the core wire and a covering crimp portion crimped to the covering, and a resin that integrally covers a range from a tip of the core wire to side surfaces of the covering crimp portion. The covering crimp portion includes a bottom wall portion, a first crimping piece, and a second crimping piece. The covering crimp portion has a configuration in which each of the bottom wall portion, the first crimping piece, and the second crimping piece is in close contact with the covering.

8 Claims, 9 Drawing Sheets

ELECTRIC WIRE WITH TERMINAL

CROSS-REFERENCE TO RELATED APPLICATION(S)

The present application claims priority to and incorporates by reference the entire contents of Japanese Patent Application No. 2019-095020 filed in Japan on May 21, 2019.

BACKGROUND OF THE INVENTION

1. Field of the Invention

The present invention relates to an electric wire with a terminal.

2. Description of the Related Art

Conventionally, there have been techniques for applying a resin to an electric wire with a terminal (Japanese Patent Application Laid-open No. 2015-41404). Japanese Patent Application Laid-open No. 2016-181387 discloses an electric wire with a terminal including a covered electric wire, a terminal including a conductor crimp portion and a covering crimp portion, and an ultraviolet-curable resin member covering the conductor exposed from an insulating covering. In the terminal-equipped electric wire of Japanese Patent Application Laid-open No. 2016-181367, the whole of the conductor crimping portion and the covering crimp portion is covered with a resin member.

Here, applying a resin to the covering crimp portion might cause an increase in the terminal height.

SUMMARY OF THE INVENTION

An object of the present invention is to provide an electric wire with a terminal capable of improving the anticorrosion performance while suppressing the terminal height.

An electric wire with a terminal according to one aspect of the present invention includes an electric wire having a core wire and a covering that exposes an end of the core wire and covers the core wire; a crimp terminal having a core wire crimp portion crimped to the core wire, and a covering crimp portion crimped to the covering; and a resin that integrally covers a range from a tip of the core wire to a side surface of the covering crimp portion and that shields the core wire from an external space, wherein the covering crimp portion Includes a bottom wall portion, a first crimping piece extending from one end of the bottom wall portion in a width direction, and a second crimping piece extending from the other end of the bottom wall portion in the width direction, the covering crimp portion has a configuration in which each of the bottom wall portion, the first crimping piece, and the second crimping piece is in close contact with the covering, and the covering crimp portion is crimped to the covering with a tip surface of the first crimping piece and a tip surface of the second crimping piece facing each other in a circumferential direction, and the resin closes a facing portion at which the tip surface of the first crimping piece and the tip surface of the second crimping piece face each other, from a side of the core wire crimp portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an electric wire with a terminal according to an embodiment of the present invention will be described in detail with reference to the drawings. Note that the present invention is not limited by the embodiment. Moreover, components in the following embodiment include those that can be easily assumed by those skilled in the art or substantially identical.

Embodiment

Figure 1:
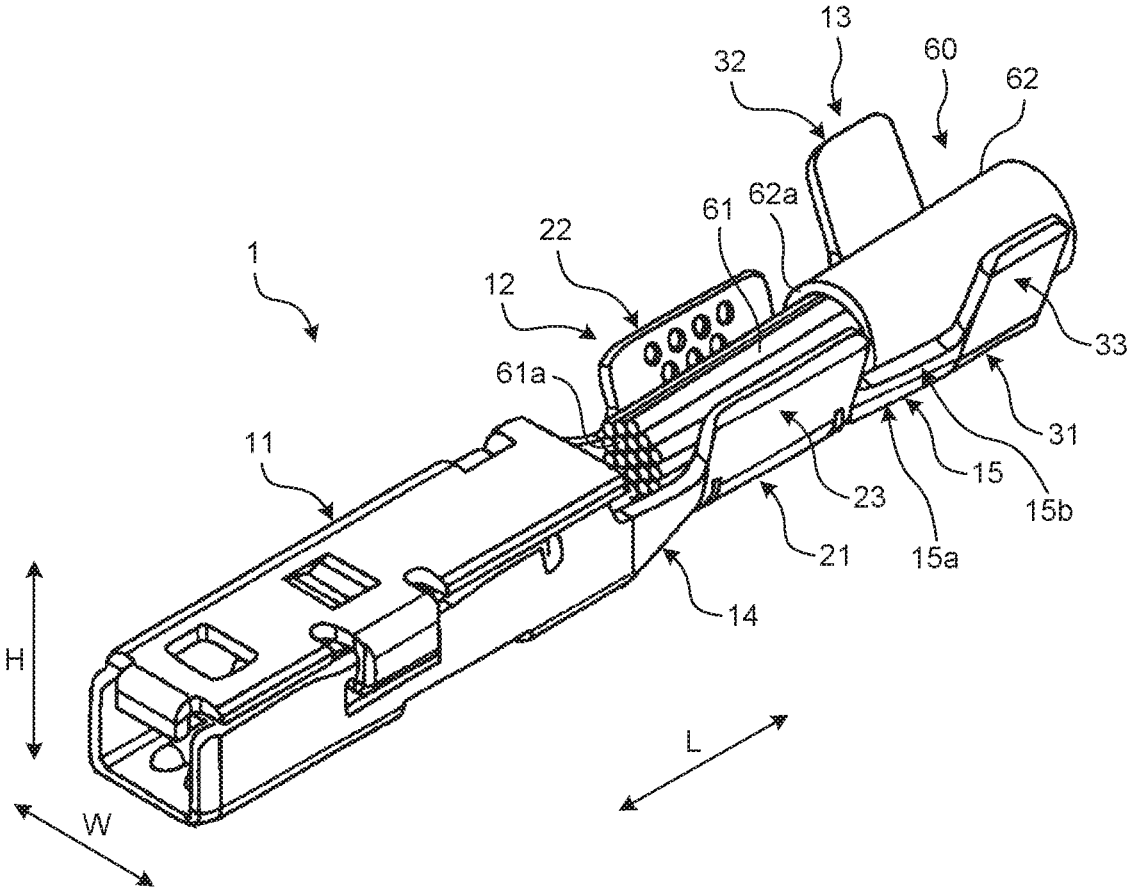
FIG. 1 is a perspective view illustrating a crimp terminal and an electric wire of an embodiment.
Figure 2:
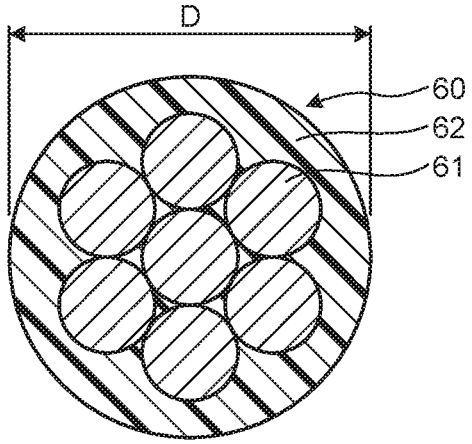
FIG. 2 is a cross-sectional view of an electric wire according to an embodiment.
Figure 3:
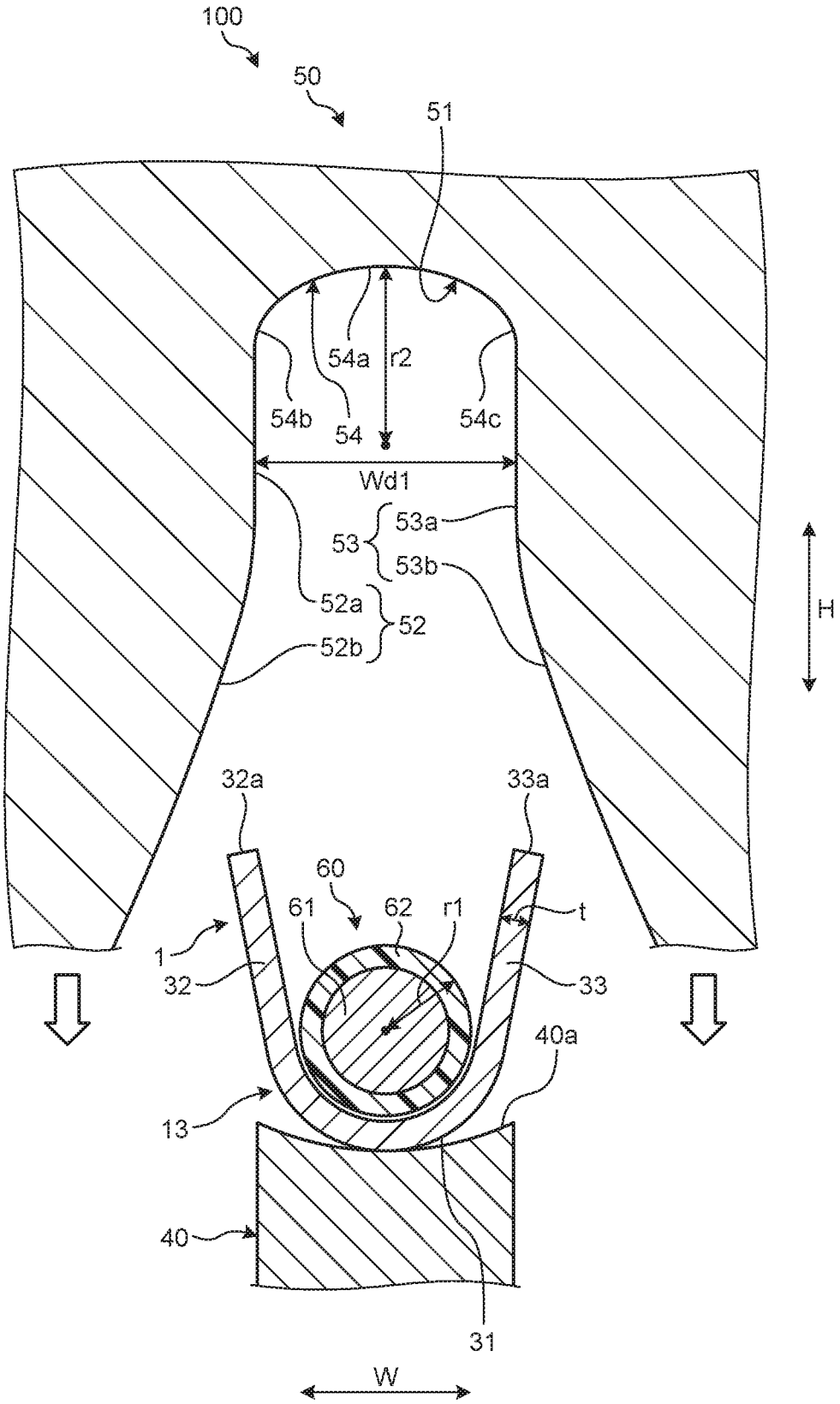
FIG. 3 is a cross-sectional view of a terminal crimping device according to an embodiment.
Figure 4:
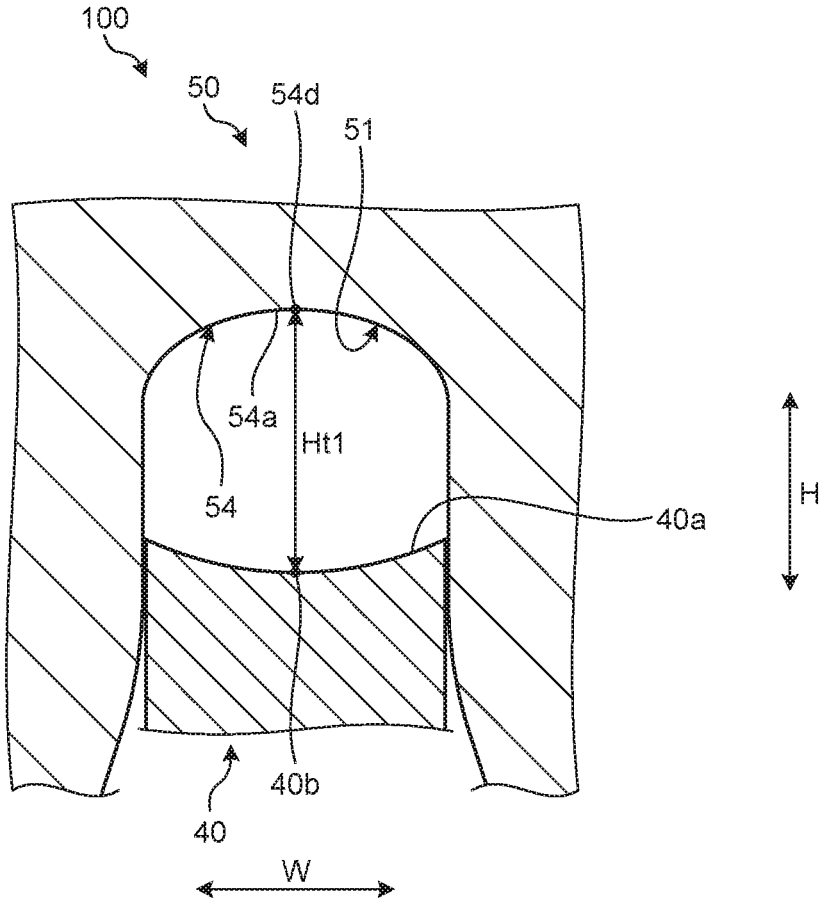
FIG. 4 is a front view of a terminal crimping device of an embodiment when an upper mold is at a bottom dead center.
Figure 5:
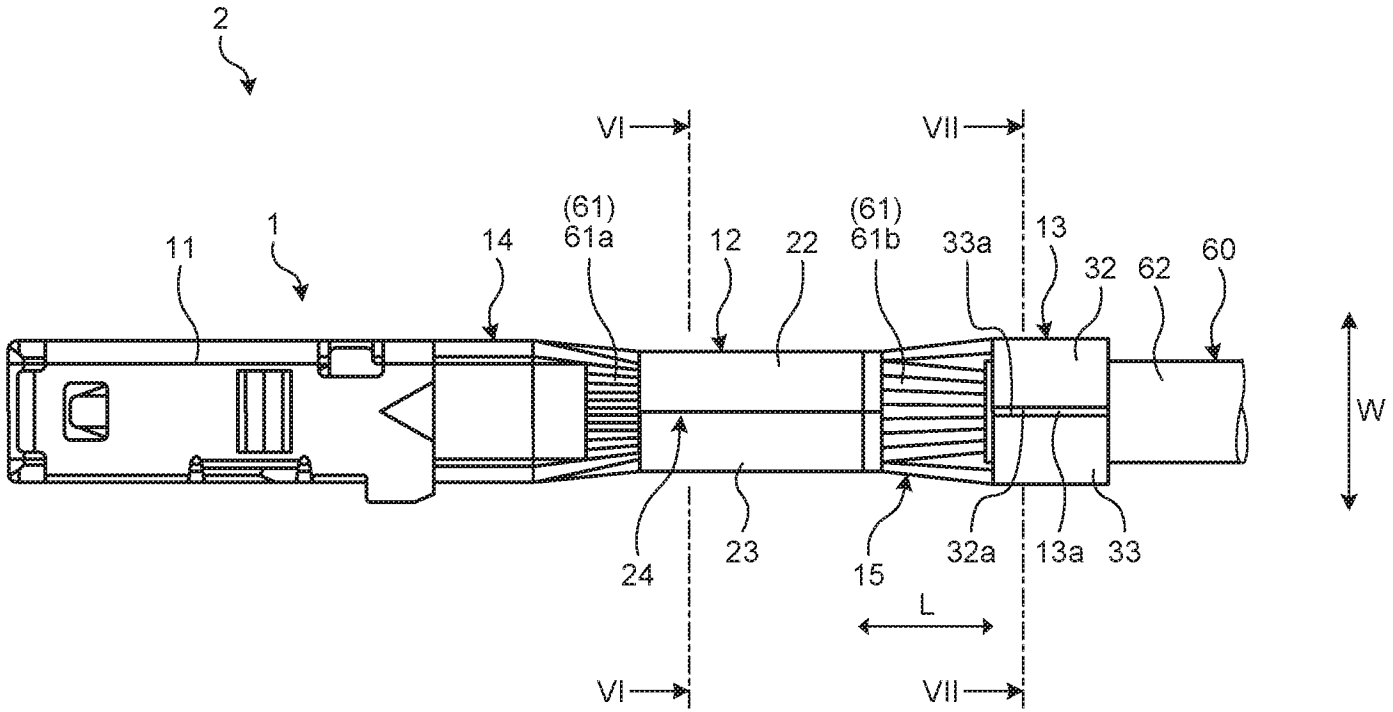
FIG. 5 is a plan view of an electric wire with a terminal according to an embodiment before a resin is applied.
Figure 6:
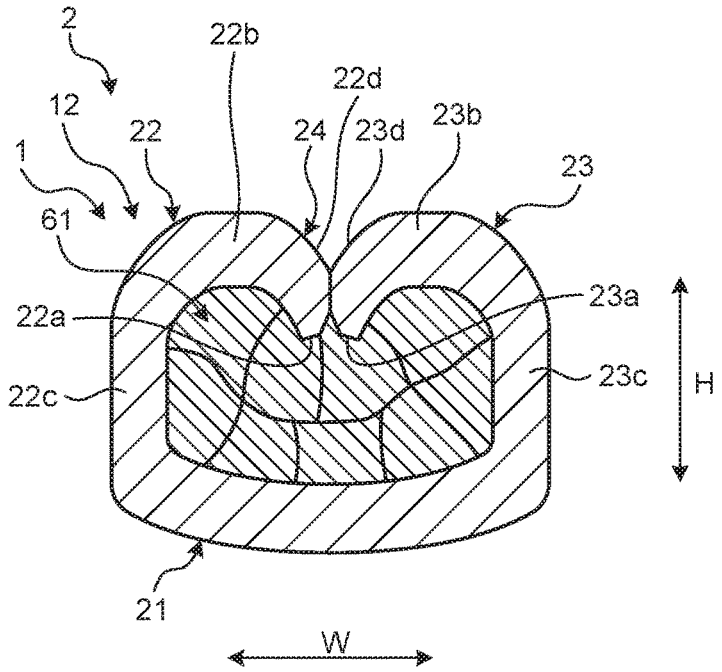
FIG. 6 is a cross-sectional view of a core wire crimp portion of an electric wire with a terminal according to an embodiment.
Figure 7:
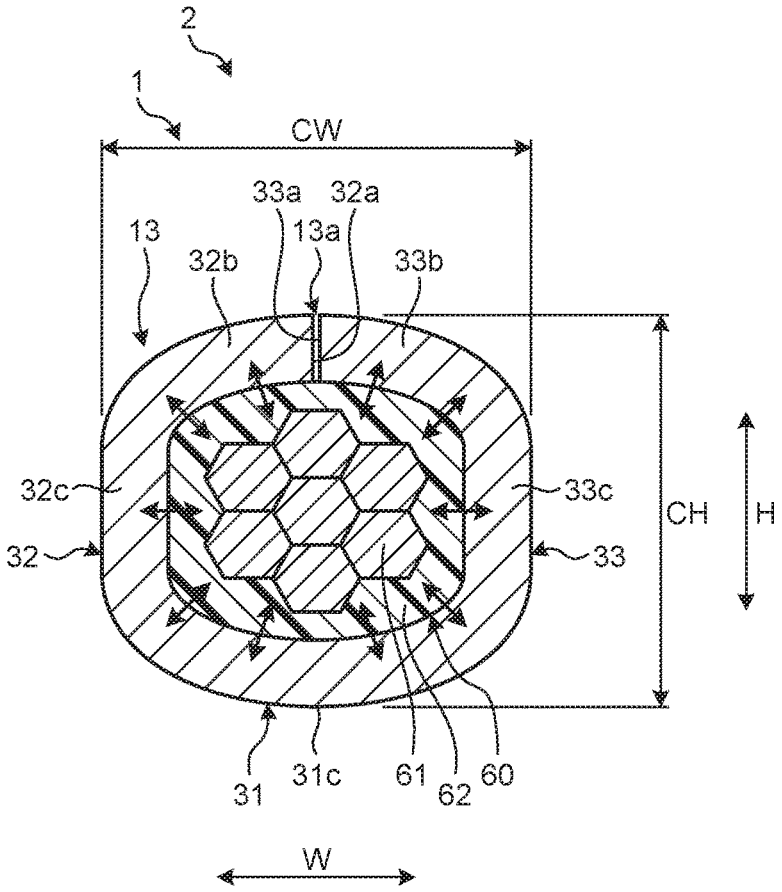
FIG. 7 is a cross-sectional view of a covering crimp portion of an electric wire with a terminal according to an embodiment.
Figure 8:
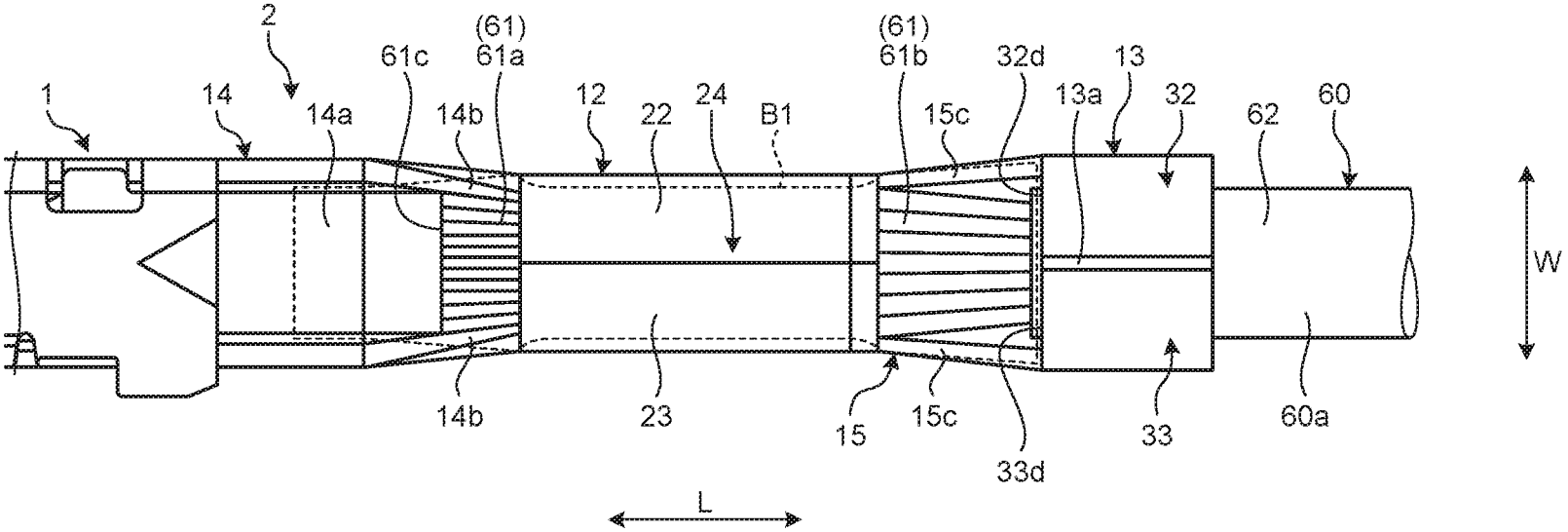
FIG. 8 is a plan view illustrating a resin application range of an embodiment.
Figure 9:
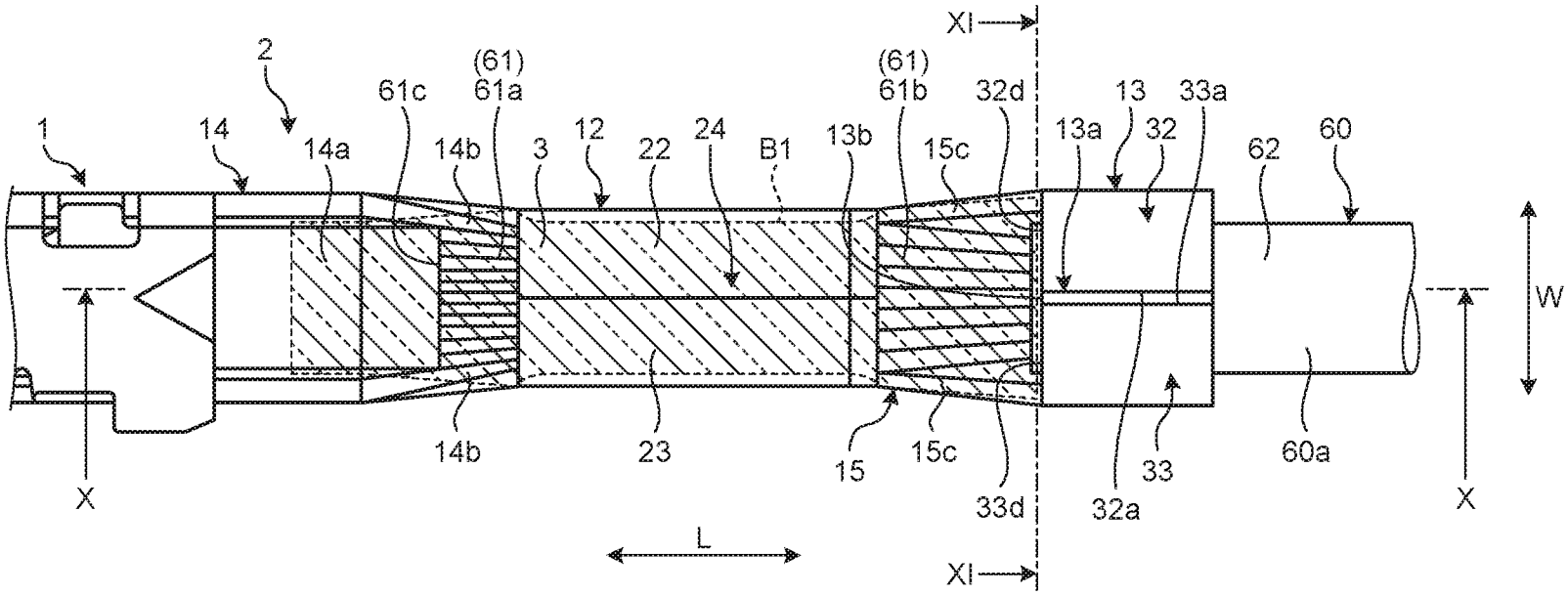
FIG. 9 is a plan view of an electric wire with a terminal according to an embodiment.
Figure 10:
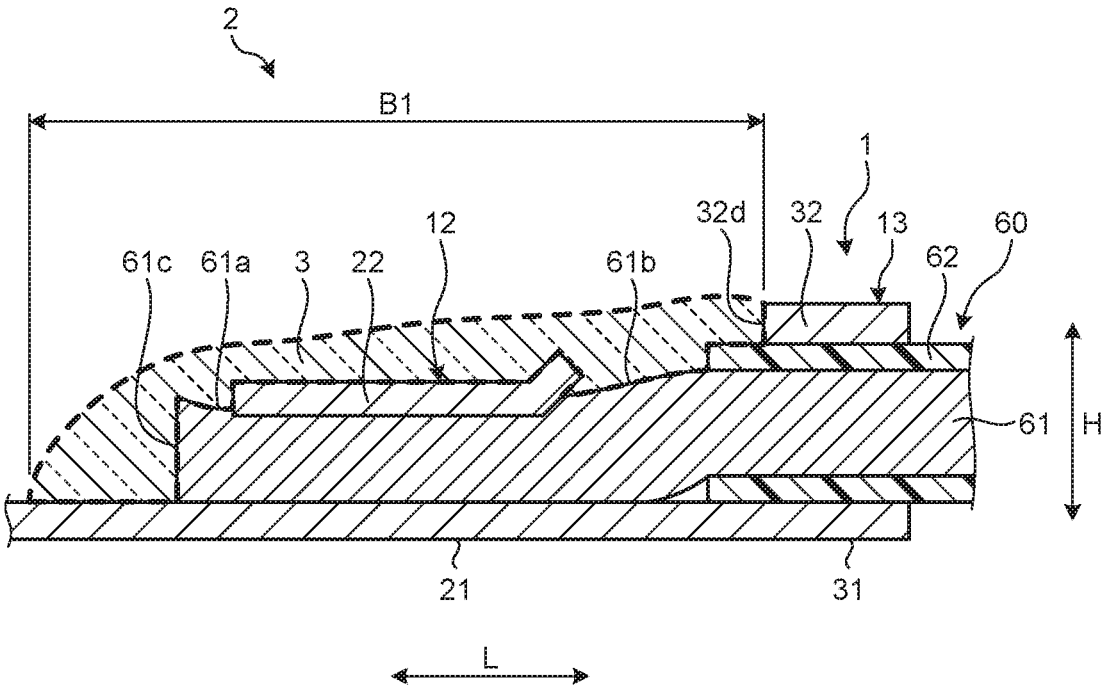
FIG. 10 is a longitudinal cross-sectional view of an electric wire with a terminal according to an embodiment.

An embodiment will be described with reference to FIGS. 1 to 12. The present embodiment relates to an electric wire with a terminal. FIG. 1 is a perspective view illustrating a crimp terminal and an electric wire of an embodiment. FIG. 2 is a cross-sectional view of an electric wire according to an embodiment. FIG. 3 is a cross-sectional view of a terminal crimping device according to an embodiment. FIG. 4 is a front view of a terminal crimping device of an embodiment when an upper mold is at the bottom dead center. FIG. 5 is a plan view of an electric wire with a terminal according to an embodiment before resin is applied. FIG. 6 is a cross-sectional view of a core wire crimp portion of an electric wire with a terminal according to an embodiment. FIG. 7 is a cross-sectional view of a covering crimp portion of an electric wire with a terminal according to an embodiment. FIG. 8 is a plan view illustrating a resin application range of an embodiment. FIG. 9 is a plan view of an electric wire with a terminal according to an embodiment. FIG. 10 is a longitudinal cross-sectional view of an electric wire with a terminal according to an embodiment.

Figure 11:
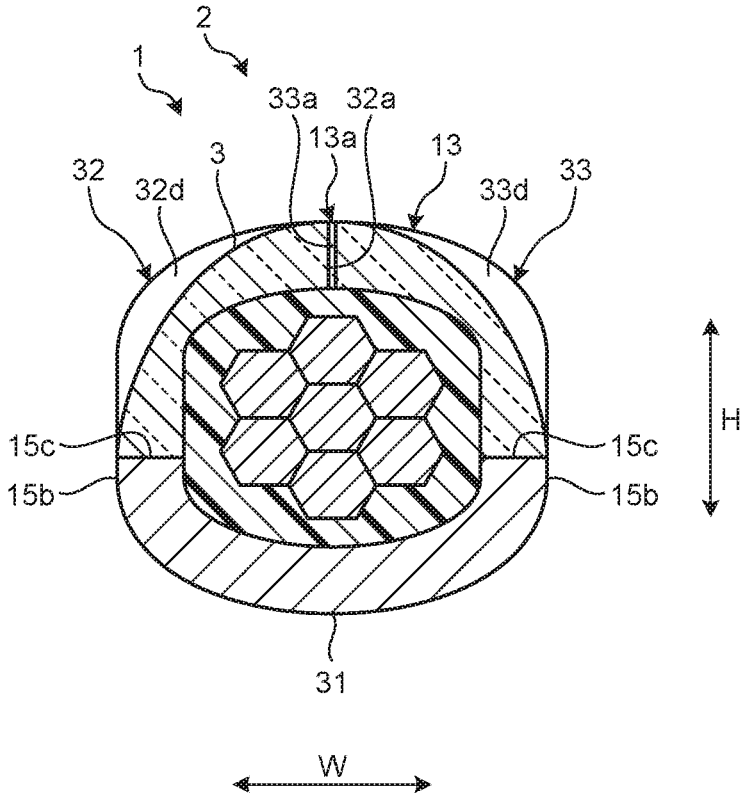
FIG. 11 is a lateral cross-sectional view of an electric wire with a terminal according to an embodiment.

FIG. 11 is a lateral cross-sectional view of an electric wire with a terminal according to an embodiment.

FIG. 6 illustrates a cross section taken along line VI-VI of FIG. 5. FIG. 7 illustrates a cross section taken along line VII-VII of FIG. 5. FIG. 10 illustrates a cross section taken along line X-X of FIG. 9. FIG. 11 illustrates a cross section taken along line XI-XI of FIG. 9.

As illustrated in FIG. 1, a crimp terminal 1 according to the present embodiment includes a terminal connecting portion 11, a core wire crimp portion 12, and a covering crimp portion 13. The terminal connecting portion 11, the core wire crimp portion 12, and the covering crimp portion 13 are arranged in this order in a longitudinal direction of the crimp terminal 1. The crimp terminal 1 is formed from a conductive metal plate (for example, a copper plate or a copper alloy plate) as a base material. The crimp terminal 1 is formed into a predetermined shape by punching or bending the base material. The surface of the crimp terminal 1 may be plated with tin (Sn) or the like.

In the description of the crimp terminal 1 in the present specification, a connection direction with the counterpart terminal, that is, an insertion direction with respect to the counterpart terminal is referred to as a first direction L. The first direction L is the longitudinal direction of the crimp terminal 1. A width direction of the crimp terminal 1 is referred to as a second direction W. The second direction W is orthogonal to the first direction L. In the crimp terminal 1, a direction orthogonal to both the first direction L and the second direction W is referred to as a third direction H. The third direction H is a compression direction by an upper mold 50 when the crimp terminal 1 is crimped. The third direction H is a height direction of the crimp terminal 1.

The terminal connecting portion 11 is a portion electrically connected to a counterpart terminal. The shape of the terminal connecting portion 11 of the present embodiment is a rectangular tube shape. The core wire crimp portion 12 is a portion to be crimped to a core wire 61 of an electric wire 60. The electric wire 60 includes a core wire 61 and an insulating covering 62 covering the core wire 61. Examples of the material of the core wire 61 include copper and aluminum. As illustrated in FIG. 2, the cross-sectional shape of the electric wire 60 of the present embodiment is circular. The outer diameter of the electric wire 60 is referred to as a finished outer diameter D. The finished outer diameter D is the outer diameter of the electric wire 60 before the crimp terminal 1 is crimped to the electric wire 60. The finished outer diameter D of the electric wire with a terminal 2 (refer to FIG. 8 or the like) corresponds to an outer diameter of the covering 62 of a portion 60*a* of the electric wire 60 to which the crimp terminal 1 is not crimped.

As illustrated in FIG. 1, in the electric wire 60, the covering 62 at the end is removed to expose the core wire 61 by a predetermined length. The core wire 61 of the present embodiment is a group of a plurality of strands. Alternatively, the core wire 61 may be a single wire such as a coaxial cable. The crimp terminal 1 is crimped to the end of the electric wire 60 and thereby electrically connected to the exposed core wire 61.

The shape of the core wire crimp portion 12 before being crimped to the core wire 61 is a U-shape as illustrated in FIG. 1. The core wire crimp portion 12 includes a bottom wall portion 21, a first crimping piece 22, and a second crimping piece 23. The bottom wall portion 21 is a portion to be a bottom wall of the core wire crimp portion 12, and is supported by a lower mold 40 described below. The first crimping piece 22 and the second crimping piece 23 are a pair of conductor crimping pieces to be crimped to the core wire 61. The first crimping piece 22 is a side wall portion extending from one end of the bottom wall portion 21 in the width direction. The second crimping piece 23 is a side wall portion extending from the other end in the width direction of the bottom wall portion 21. The first crimping piece 22 and the second crimping piece 23 extend in a direction intersecting the width direction of the bottom wall portion 21. The first crimping piece 22 and the second crimping piece 23 face each other in the second direction W. As illustrated in FIG. 1, the interval between the first crimping piece 22 and the second crimping piece 23 increases from the bottom wall portion 21 side toward the tip side.

As illustrated in FIG. 1, the covering crimp portion 13 includes a bottom wall portion 31, a first crimping piece 32, and a second crimping piece 33. The shape of the covering crimp portion 13 before being crimped to the covering 62 is a U-shape as illustrated in FIGS. 1 and 3. The bottom wall portion 31 is a portion to be a bottom wall of the covering crimp portion 13. The first crimping piece 32 and the second crimping piece 33 are a pair of covering crimping pieces to be crimped to the covering 62. The first crimping piece 32 is a side wall portion extending from one end of the bottom wall portion 31 in the width direction. The second crimping piece 33 is a side wall portion extending from the other end of the bottom wall portion 31 in the width direction. The first crimping piece 32 and the second crimping piece 33 face each other in the second direction W. The interval between the first crimping piece 32 and the second crimping piece 33 increases from the bottom wall portion 31 side toward the tip side.

The terminal connecting portion 11 and the core wire crimp portion 12 are connected via an intermediate portion 14. The height of the intermediate portion 14 is lower than any of the height of the terminal connecting portion 11 and the height of the core wire crimp portion 12. The core wire crimp portion 12 and the covering crimp portion 13 are connected via an intermediate portion 15. The intermediate portion 15 includes a bottom wall portion 15*a* and a side wall portion 15*b*. The bottom wall portion 15*a* connects the bottom wall portion 21 of the core wire crimp portion 12 with the bottom wall portion 31 of the covering crimp portion 13. The side wall portion 15*b* extends from both ends of the bottom wall portion 15*a* in the width direction. One side wall portion 15*b* connects the first crimping piece 22 of the core wire crimp portion 12 with the first crimping piece 32 of the covering crimp portion 13. The other side wall portion 15*b* connects the second crimping piece 23 of the core wire crimp portion 12 with the second crimping piece 33 of the covering crimp portion 13. The height of the side wall portion 15*b* is lower than any of the heights of the crimping pieces 22 and 23 of the core wire crimp portion 12 and the heights of the crimping pieces 32 and 33 of the covering crimp portion 13.

As illustrated in FIG. 1, the electric wire 60 is mounted on the crimp terminal 1 such that an axial direction of the electric wire 60 is aligned with the longitudinal direction of the crimp terminal 1. In a state of being mounted on the crimp terminal 1, a tip 61*a* of the core wire 61 is directed to the terminal connecting portion 11. The core wire 61 exposed to the outside from the covering 62 is mounted on the core wire crimp portion 12. At this time, the tip 61*a* of the core wire 61 may protrude from the core wire crimp portion 12 to the terminal connecting portion 11 side. The covering 62 of the electric wire 60 is mounted on the covering crimp portion 13. The electric wire 60 is installed so that a tip 62*a* of the covering 62 is positioned between the core wire crimp portion 12 and the covering crimp portion 13, for example.

The core wire crimp portion 12 and the covering crimp portion 13 are crimped to the electric wire 60 by the lower mold 40 and the upper mold 50 as illustrated in FIG. 3. The lower mold 40 and the upper mold 50 are components of a terminal crimping device 100. The lower mold 40 is a support-side mold that supports the core wire crimp portion 12 and the covering crimp portion 13 from below. A support surface 40*a* of the lower mold 40 supports an outer surfaces of the bottom wall portions 21 and 31 of the crimp terminal 1. The cross-sectional shape of the support surface 40*a* is an arc shape, for example. FIG. 3 illustrates the covering crimp portion 13 supported by the lower mold 40. The first crimping piece 32 and the second crimping piece 33 are in a posture extending diagonally upward from the bottom wall portion 31 in a state where the covering crimp portion 13 is supported by the lower mold 40. Similarly, the lower mold 40 supports the core wire crimp portion 12 from below.

The upper mold 50 is a terminal crimping mold that sandwiches the crimp terminal 1 and the electric wire 60 between the lower mold 40 and oneself and thereby crimps the crimp terminal 1 to the electric wire 60. The upper mold 50 sandwiches the core wire crimp portion 12 and the core wire 61 between the lower mold 40 and oneself and thereby crimps the core wire crimp portion 12 to the core wire 61. In addition, the upper mold 50 sandwiches the covering crimp portion 13 and the covering 62 between the lower mold 40 and oneself and thereby crimps the covering crimp portion 13 to the covering 62. As illustrated in FIG. 3, the upper mold 50 is disposed above the lower mold 40. The upper mold 50 moves relative to the lower mold 40 in the third direction H. The terminal crimping device 100 includes a driving device that moves the upper mold 50 up and down in the third direction H.

The upper mold 50 has a crimping surface 51 that crimps the covering crimp portion 13. The crimping surface 51 includes a first wall surface 52, a second wall surface 53, and a facing surface 54. The first wall surface 52, the second wall surface 53, and the facing surface 54 are continuous with each other and form a groove opening downward. The first wall surface 52 and the second wall surface 53 face each other in the second direction W. The first wall surface 52 includes a flat portion 52*a* and a curved portion 52*b*. The second wall surface 53 includes a flat portion 53*a* and a curved portion 53*b*. The flat portions 52*a* and 53*a* extend in the first direction L and the third direction H, and are orthogonal to the second direction W. The flat portions 52*a* and 53*a* face each other in the second direction W and are parallel to each other.

The curved portions 52*b* and 53*b* extend downward from the flat portions 52*a* and 53*a*, respectively. The curved portions 52*b* and 53*b* face each other in the second direction W, and are gently curved so that the interval between the curved portions increases downward.

The facing surface 54 connects an upper end of the first wall surface 52 and an upper end of the second wall surface 53. The facing surface 54 faces the support surface 40*a* of the lower mold 40 in the third direction H. The facing surface 54 is a curved surface that is recessed upward. The facing surface 54 includes a central portion 54*a* located at the center in the second direction W, and connecting portions 54*b* and 54*c* located at both ends in the second direction W. The central portion 54*a* and the connecting portions 54*b*, 54*c* are each curved to protrude upward. A radius of curvature r2 of the central portion 54*a* in the cross section orthogonal to the first direction L is larger than a radius r1 of the electric wire 60, for example.

The connecting portion 54*b* connects the central portion 54*a* with the flat portion 52*a* of the first wall surface 52. The connecting portion 54*c* connects the central portion 54*a* with the flat portion 53*a* of the second wall surface 53. The curvatures of the connecting portions 54*b* and 54*c* gradually vary from the central portion 54*a* toward the flat portions 52*a* and 53*a*.

The flat portions 52*a* and 53*a* of the present embodiment are configured to enable the first crimping piece 32 and the second crimping piece 33 to be brought into close contact with the covering 62 of the electric wire 60, as described below. More specifically, an interval Wd1 between the flat portion 52*a* of the first wall surface 52 and the flat portion 53*a* of the second wall surface 53 is defined so as to allow the covering 62 to be compressed from both sides in the second direction W by the crimping pieces 32 and 33. The interval Wd1 in the second direction W satisfies the following Formula (1). The interval Wd1 preferably satisfies the following Formula (2). Here, D: the finished outer diameter of the electric wire 60, and t: the plate thickness of the covering crimp portion 13.

$$Wd1<D+2\times t \quad (1)$$

$$Wd1>D \quad (2)$$

The position of the bottom dead center of the upper mold 50 is defined to enable the first crimping piece 32 and the second crimping piece 33 to be brought into close contact with the covering 62 of the electric wire 60. FIG. 4 illustrates the terminal crimping device 100 in a state where the upper mold 50 is at the bottom dead center. In a case where the upper mold 50 is at the bottom dead center, a distance Ht1 between the support surface 40*a* and the facing surface 54 is defined to allow the covering crimp portion 13 to compress the covering 62 from both sides in the third direction H. Note that the distance Ht1 is a distance in the third direction H from a lowermost portion 40*b* of the support surface 40*a* to an uppermost portion 54*d* of the facing surface 54. In the present embodiment, the lowermost portion 40*b* of the support surface 40*a* corresponds to the center of the support surface 40*a* in the second direction W. The uppermost portion 54*d* of the facing surface 54 corresponds to the center of the facing surface 54 in the second direction W. That is, the lowermost portion 40*b* and the uppermost portion 54*d* are on an identical line in the third direction H.

The distance Ht1 satisfies the following Formula (3). The distance Ht1 preferably satisfies the following Formula (4).

$$Ht1<D+2-t \quad (3)$$

$$Ht1>D \quad (4)$$

A downward movement of the upper mold 50 to the bottom dead center will allow the crimp terminal 1 to be crimped to the electric wire 60 as illustrated in FIGS. 5 to 7. As illustrated in FIG. 5, the core wire crimp portion 12 is crimped to the core wire 61. The tip 61*a* of the core wire 61 protrudes from the core wire crimp portion 12 toward the terminal connecting portion 11. The covering crimp portion 13 is crimped to the covering 62. An intermediate exposed portion 61*b* of the core wire 61 is exposed between the core wire crimp portion 12 and the covering crimp portion 13.

As illustrated in FIG. 6, the core wire crimp portion 12 is crimped to the core wire 61 in a substantially B shape. The cross-sectional shape of each of the first crimping piece 22 and the second crimping piece 23 after crimping is a curved shape protruding toward the side opposite to the bottom wall portion 21 aide. More specifically, the first crimping piece 22 has a curved portion 22*b* and a base portion 22*c*. The base portion 22*c* is a portion extending linearly from the bottom wall portion 21 in the third direction H. The curved portion 22*b* is a portion of the first crimping piece 22 on more tip side compared with the base portion 22*c*, and is curved outward.

The second crimping piece 23 includes a curved portion 23*b* and a base portion 23*c*. The base portion 23*c* is a portion extending linearly from the bottom wall portion 21 in the third direction H. The curved portion 23*b* is a portion of the second crimping piece 23 on more tip side compared with the base portion 23*c*, and is curved outward. A portion where an outer surface 22*d* of the first crimping piece 22 and an outer surface 23*d* of the second crimping piece 23 come in contact is formed into a groove 24. The groove 24 extends in the first direction L.

As illustrated in FIG. 7, the covering crimp portion 13 is crimped to the covering 62 so as to form an annular shape. Each of the cross-sectional shapes of the first crimping piece 32 and the second crimping piece 33 after crimping is a shape protruding outward. More specifically, the first crimping piece 32 includes a curved portion 32*b* and a base portion 32*c*. The base portion 32*c* is a portion extending linearly from the bottom wall portion 31 in the third direction H. The curved portion 32*b* is a portion of the first crimping piece 32 on more tip side compared with the base portion 32*c*. The curved portion 32*b* is curved outward. In the curved portion 32*b*, the tip is located on the uppermost side.

The second crimping piece 33 has a curved portion 33*b* and a base portion 33*c*. The base portion 33*c* is a portion extending linearly from the bottom wall portion 31 in the third direction H. The curved portion 33*b* is a portion of the second crimping piece 33 on more tip side compared with the base portion 33*c*, and is curved outward. In the curved portion 33*b*, the tip is located at the uppermost position. The base portion 32*c* of the first crimping piece 32 and the base portion 33*c* of the second crimping piece 33 may be parallel to each other. In the present embodiment, the outer surface of the base portion 32*c* and the outer surface of the base portion 33*c* are parallel to each other and are orthogonal to the second direction W. The base portions 32*c* and 33*c* are respectively formed by the flat portions 52*a* and 53*a* of the upper mold 50.

A tip surface 32*a* of the first crimping piece 32 and a tip surface 33*a* of the second crimping piece 33 face each other in the circumferential direction. Here, the circumferential direction is a circumferential direction about a center axis of the electric wire 60 as the center of rotation. In the crimp terminal 1 of the present embodiment, the length of the first crimping piece 32 is equal to the length of the second crimping piece 33, and thus, the two tip surfaces 32*a* and 33*a* face each other at the top of the covering crimp portion 13. Furthermore, the two tip surfaces 32*a* and 33*a* face each other in the second direction W. The two tip surfaces 32*a* and 33*a* may be in contact with each other or may face each other across a slight gap. The covering crimp portion 13 may be crimped such that the tip surfaces 32*a* and 33*a* are parallel to each other.

In the cohering crimp portion 13, the bottom wall portion 31, the first crimping piece 32, and the second crimping piece 33 are each in close contact with the covering 62. In other words, the covering crimp portion 13 is in close contact with the outer peripheral surface of the covering 62 over the entire circumference. Furthermore, the covering crimp portion 13 compresses the covering 62 inward in the radial direction over the entire circumference. Accordingly, the covering 62 is compressed in a state of being sandwiched between the covering crimp portion 13 and the core wire 61. As a result, the covering 62 generates a repulsive force repelling toward the covering crimp portion 13. Therefore, generation of a gap between the covering crimp portion 13 and the covering 62 is suppressed.

The covering crimp portion 13 according to the present embodiment is crimped to the covering 62 so as to satisfy the following Formulas (5) and (7). The covering crimp portion 13 is preferably crimped to the covering 62 so as to satisfy the following Formulas (6) and (8). Here, CH: terminal height in the covering crimp portion 13, and CW: terminal width in the covering crimp portion 13. The terminal height CH of the covering crimp portion 13 is, for example, the maximum dimension in the third direction H in the lateral cross section of the covering crimp portion 13. The terminal height CH of the present embodiment is a height in the third direction H from the outer surface of the center 31*c* of the bottom wall portion 31 to the outer surfaces of the tips of the crimping pieces 32 and 33. The terminal width CW of the covering crimp portion 13 is, for example, the maximum dimension in the second direction W in the lateral cross section of the covering crimp portion 13. The terminal width CW of the present embodiment is a distance in the second direction W from the outer surface of the base portion 32*c* to the outer surface of the base portion 33*c*.

$$CH<D+2\times t \tag{5}$$

$$CH>D \tag{6}$$

$$CW<D+2\times t \tag{7}$$

$$CW>D \tag{8}$$

When Formulas (5) and (7) are satisfied, the covering crimp portion 13 is crimped to the covering 62 while compressing the covering 62 toward the core wire 61 in each of the second direction W and the third direction H. The covering crimp portion 13 of the present embodiment is crimped so that the terminal width CW is greater than the terminal height CH. However, the relationship between the terminal width CW and the terminal height CH is not limited to the above relationship. For example, the covering crimp portion 13 may be crimped so that the terminal width CW and the terminal height CH are equal, or may be crimped so that the terminal height CH is greater than the terminal width CW.

After completion of the crimping step of crimping the crimp terminal 1 on the electric wire 60, an application step of applying a resin 3 is executed. FIG. 8 illustrates an application range B1 within which the resin 3 is applied. The application range B1 is a region expanding in the first direction L and the second direction W. The application range B1 is a range including from the tip 61*a* of the core wire 61 to side surfaces 32*d* and 33*d* of the covering crimp portion 13. More specifically, the application range B1 is a region including the tip 61*a* of the core wire 61 including an end surface 61*c*, a bottom portion 14*a* and an end surface 14*b* of the intermediate portion 14, the groove 24 of the core wire crimp portion 12, the intermediate exposed portion 61*b*, an end surface 15*c* of the intermediate portion 15, the side surface 32*d* of the first crimping piece 32, and the side surface 33*d* of the second crimping piece 33. The side surfaces 32*d* and 33*d* are side surfaces on the core wire crimp portion 12 side, and are surfaces facing the core wire crimp portion 12 side.

Figure 12:
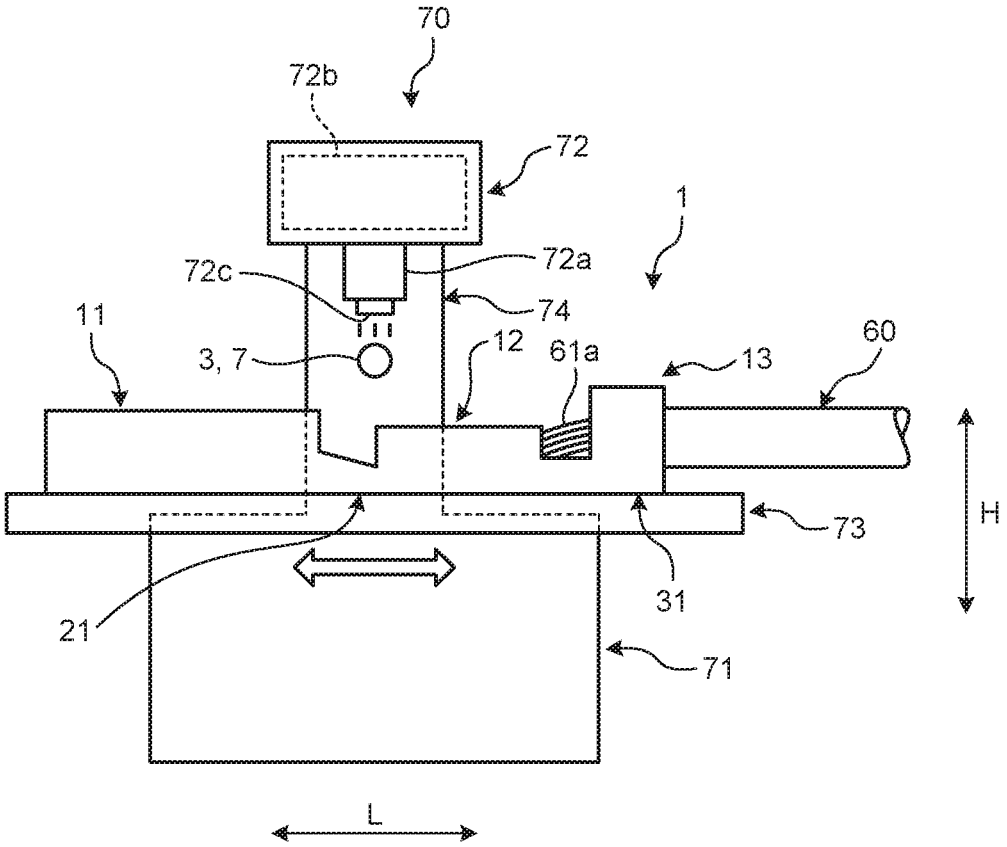
FIG. 12 is a front view of an application device according to an embodiment.

In the application step, the resin 3 is applied by an application device 70 illustrated in FIG. 12, for example. The application device 70 includes a main body 71, an injection unit 72, and a holding unit 73. The injection unit 72 is supported by the main body 71 via an arm unit 74. The injection unit 72 includes a nozzle 72*a* and an injection mechanism 72*b*. The nozzle 72*a* is a cylindrical hollow member. The ejection port 72*c* at the tip of the nozzle 72*a* faces the holding unit 73. The injection mechanism 72*b* is a mechanism for intermittently injecting droplets 7 of the resin 3 from the nozzle 72*a*.

The holding unit 73 is a portion that holds the crimp terminal 1, and is relatively movable with respect to the main body 71. The application device 70 injects the droplets 7 of the resin 3 from the nozzle 72*a* while moving the holding unit 73 so as to apply the resin 3 to the electric wire 60 and the crimp terminal 1. The applied resin 3 is an ultraviolet curable resin, for example. The resin 3 to be used may be a thermosetting resin or a two-component curable resin, for example.

As illustrated in FIGS. 9 and 10, the application device 70 applies the resin 3 to the application range B1. The core wire 61 is shielded from the external space by the applied resin 3. The resin 3 serves as a protective film that covers the electric wire 60 and the crimp terminal 1 integrally and protects the core wire 61. The resin 3 is applied so as to close a facing portion 13*a* of the covering crimp portion 13 from the core wire crimp portion 12 side. The facing portion 13*a* is a gap between the two tip surfaces 32*a* and 33*a*. That is, the resin 3 is applied so as to close the opening 13*b* on the core wire crimp portion 12 side in the facing portion 13*a*.

As illustrated in FIG. 11, the resin 3 is applied so as to cover the side surface 32*d* of the first crimping piece 32 and the side surface 33*d* of the second crimping piece 33. In addition, the resin 3 closes the facing portion 13*a* where the tip surface 32*a* of the first crimping piece 32 and the tip surface 33*a* of the second crimping piece 33 face each other. The resin 3 closes the lower end to the upper end of the opening 13*b*, for example.

When the application step is completed, a curing step is executed. The curing step is a step of curing the applied resin 3. The ultraviolet curing resin 3 is irradiated with ultraviolet rays in a curing step. The curing step is executed to fix the resin 3 to the core wire 61, the covering 62, and the crimp terminal 1 so as to form a resin film that integrally covers the core wire 61, the covering 62, and the crimp terminal 1. The curing step cures the resin 3 to complete formation of the electric wire with a terminal 2. The resin 3 cures while the facing portion 13*a* is shielded from the core wire crimp portion 12 side.

According to the electric wire with a terminal 2 of the present embodiment, infiltration of water is suppressed by the covering crimp portion 13 and the resin 3, leading to suppression of a decrease in electrical performance. For example, in a case where water enters the facing portion 13*a*, the water is blocked by the resin 3 film at the opening 13*b*. The resin 3 regulates the entry of water into the electrical connection between the core wire 61 and the crimp terminal 1, thereby suppressing occurrence of corrosion of the core wire 61 and the crimp terminal 1. In addition, the covering crimp portion 13 is in close contact with the outer peripheral surface of the covering 62, and suppresses the infiltration of water. In other words, the covering 62 functions as a seal in close contact with the covering crimp portion 13.

As a comparative example, an electric wire with a terminal in which the resin 3 is applied to the upper surface of the covering crimp portion 13 in the application step and the facing portion 13*a* is filled with the resin 3 will be considered. In the electric wire with a terminal of the comparative example, the terminal height CH in the covering crimp portion 13 is increased by an amount corresponding to the height of the applied resin 3, leading to enlargement of the electric wire with a terminal. In contrast, the electric wire with a terminal 2 of the present embodiment can improve the anticorrosion performance without increasing the terminal height CH. Therefore, it is possible to improve the anticorrosion performance while using the existing combination of the crimp terminal 1 and the housing as is.

As described above, the electric wire with a terminal 2 of the present embodiment includes the electric wire 60, the crimp terminal 1, and the resin 3. The electric wire 60 includes: the core wire 61; and the covering 62 that exposes the end of the core wire 61 and covers the core wire 61. The crimp terminal 1 includes: the core wire crimp portion 12 crimped to the core wire 61; and the covering crimp portion 13 crimped to the covering 62. The resin 3 integrally covers the range from the tip 61*a* of the core wire 61 to the side surfaces 32*d* and 33*d* of the covering crimp portion 13 so as to shield the core wire 61 from the external space.

The covering crimp portion 13 includes the bottom wall portion 31, the first crimping piece 32, and the second crimping piece 33. The first crimping piece 32 extends from one end of the bottom wall portion 31 in the width direction, and the second crimping piece 33 extends from the other end of the bottom wall portion 31 in the width direction. As illustrated in FIG. 7 or the like, the bottom wall portion 31, the first crimping piece 32, and the second crimping piece 33 of the covering crimp portion 13 after crimping are in close contact with the covering 62 individually. In addition, the covering crimp portion 13 is crimped to the covering 62 with the tip surface 32*a* of the first crimping piece 32 and the tip surface 33*a* of the second crimping piece 33 facing each other in the circumferential direction.

The resin 3 closes the facing portion 13*a* at which the tip surface 32*a* of the first crimping piece 32 and the tip surface 33*a* of the second crimping piece 33 face each other from the core wire crimp portion 12 side. According to the electric wire with a terminal 2 of the present embodiment, infiltration of water through the facing portion 13*a* is suppressed by the resin 3. In addition, since the covering crimp portion 13 is in close contact with the covering 62, infiltration of water into the electrical connection is suppressed. Therefore, the electric wire with a terminal 2 of the present embodiment can improve the anticorrosion performance while suppressing the terminal height CH.

The covering crimp portion 13 of the present embodiment compresses the covering 62 inward in the radial direction over the entire circumference. This configuration suppresses generation of a gap between the covering crimp portion 13 and the covering 62. For example, the covering 62 loses its plasticizer and becomes thinner when exposed to high temperatures, in some cases. Since the covering crimp portion 13 compresses the covering 62 in advance, it is possible to suppress generation of a gap between the covering crimp portion 13 and the covering 62 even when the covering 62 becomes thinner.

The resin 3 of the present embodiment closes the lower end to the upper end of the facing portion 13*a* in the height direction of the crimp terminal 1. This makes it possible to achieve sufficient, anticorrosion performance by the resin 3.

The electric wire with a terminal 2 of the present embodiment satisfies Formulas (5) and (7). Accordingly, it is possible to eliminate a gap between the covering crimp portion 13 and the covering 62, enabling generation of a repulsive force in the covering 62. This makes it possible to suitably suppress the infiltration of the corrosive liquid such as salt water into the electrical connection between the core wire 61 and the crimp terminal 1.

$$CH<D+2\times t \quad (5)$$

$$CW<D+2\times t \quad (7)$$

Modification of Embodiment

A modification of an embodiment will be described. The crimping shape of the covering crimp portion 13 is not limited to the shape exemplified in the above embodiment. The covering crimp portion 13 may be crimped in a shape referred to as a D crimp. In the D crimp, the cross-sectional shape of the cowering crimp portion 13 is a D-shape. The bottom wall portion 31 of the covering crimp portion 13 is flat, with the first crimping piece 32 and the second crimping piece 33 crimped in a shape similar to that of the above embodiment.

The application range B1 is not limited to the range exemplified in the above embodiment. The application range B1 is appropriately determined so that the resin 3 integrally covers a range from the tip 61*a* of the core wire 61 to the side surfaces 32*d* and 33*d* of the covering crimp portion 13.

The contents disclosed in the above embodiments and modification examples can be executed in appropriate combination with each other.

In the electric wire with a terminal according to the embodiment, a covering crimp portion has a configuration in which each of a bottom wall portion, a first crimping piece, and a second crimping piece is in close contact with the covering, and the covering crimp portion is crimped to the covering with a tip surface of the first crimping piece and a tip surface of the second crimping piece facing each other in the circumferential direction. The resin closes a facing portion at which the tip surface of the first crimping piece and the tip surface of the second crimping piece face each other, from the core wire crimp portion side. According to the electric wire with a terminal according to the present embodiment, it is possible to regulate infiltration of water through a covering crimp portion without applying resin to the upper surface of the covering crimp portion. Therefore, there is an effect of improving the anticorrosion performance while suppressing the terminal height.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electric wire with a terminal comprising:

an electric wire having a core wire and a covering that exposes an end of the core wire and covers the core wire;

a crimp terminal having a core wire crimp portion crimped to the core wire, and a covering crimp portion crimped to the covering; and a resin that integrally covers a range from a tip of the core wire to a side surface of the covering crimp portion and that shields the core wire from an external space, wherein the covering crimp portion includes a bottom wall portion, a first crimping piece extending from one end of the bottom wall portion in a width direction, and a second crimping piece extending from the other end of the bottom wall portion in the width direction, the covering crimp portion has a configuration in which each of the bottom wall portion, the first crimping piece, and the second crimping piece is in close contact with the covering, and the covering crimp portion is crimped to the covering with a tip surface of the first crimping piece and a tip surface of the second crimping piece facing each other in a circumferential direction, and the resin closes a facing portion at which the tip surface of the first crimping piece and the tip surface of the second crimping piece face each other, from a side of the core wire crimp portion.

2. The electric wire with a terminal according to claim 1, wherein the covering crimp portion compresses the covering inward in a radial direction over the entire circumference.

3. The electric wire with a terminal according to claim 2, wherein the following Formulas (1) and (2) are satisfied when a terminal height in the covering crimp portion is CH, a terminal width in the covering crimp portion is CW, a finished outer diameter of the electric wire is D, and a plate thickness of the covering crimp portion is t $$CH<D+2\times t \quad (1)$$

$$CW<D+2\times t \quad (2).$$

4. The electric wire with a terminal according to claim 2, wherein the resin closes from a lower end to an upper end of the facing portion in a height direction of the crimp terminal.

5. The electric wire with a terminal according to claim 1, wherein the resin closes from a lower end to an upper end of the facing portion in a height direction of the crimp terminal.

6. The electric wire with a terminal according to claim 5, wherein the following Formulas (1) and (2) are satisfied when a terminal height in the covering crimp portion is CH, a terminal width in the covering crimp portion is CW, a finished outer diameter of the electric wire is D, and a plate thickness of the covering crimp portion is t $$CH<D+2\times t \quad (1)$$

$$CW<D+2\times t \quad (2).$$

7. The electric wire with a terminal according to claim 1, wherein the following Formulas (1) and (2) are satisfied when a terminal height in the covering crimp portion is CH, a terminal width in the covering crimp portion is CW, a finished outer diameter of the electric wire is D, and a plate thickness of the covering crimp portion is t $$CH<D+2\times t \quad (1)$$

$$CW<D+2\times t \quad (2).$$

8. The electric wire with a terminal according to claim 1, wherein the facing portion is a gap between the two tip surfaces, and the resin closes the gap.

* * * * *